United States Patent [19]

Nelson

[11] 4,151,063

[45] Apr. 24, 1979

[54] ELECTROPLATING RACK

[75] Inventor: Samuel Nelson, Providence, R.I.

[73] Assignee: Nelson Rack Company, Providence, R.I.

[21] Appl. No.: 867,918

[22] Filed: Jan. 9, 1978

[51] Int. Cl.[2] ..... C25D 17/06

[52] U.S. Cl. ..... 204/297 W

[58] Field of Search ..... 204/297 R, 297 W, 297 M; 339/256 R, 251, 256 C

[56] References Cited

U.S. PATENT DOCUMENTS

| | | | |
|---|---|---|---|
| 2,439,190 | 4/1948 | Schroeder | 204/297 W |
| 3,001,926 | 9/1961 | Belke | 204/297 W |
| 4,088,560 | 5/1978 | Swinehart et al. | 204/297 W |

OTHER PUBLICATIONS

Canning Practical Handbook on Electroplating, 11th Ed., 1932, Canning & Co., Birmingham, England, pp. 152–154.

*Primary Examiner*—F. C. Edmundson

*Attorney, Agent, or Firm*—Dike, Bronstein, Roberts, Cushman & Pfund

[57] ABSTRACT

A hanger element for an electroplating rack, specifically for suspending earrings for pierced ears for plating comprising a conductor part threaded at one end for attachment to the rack and provided at its other end with a collet for receiving the stem of an earring, a jacket of chemically inert plastic material within which the part is embedded except for the threaded end and the colleted end and a removable cap mounted on the colleted end with one end abutting the jacket and the other extending beyond the colleted end, said cap containing an axial hole for snugly receiving the colleted end and an axial passage extending beyond the end of the hole through the end of the cap for snugly receiving the stem of the earring for engagement within the collet.

11 Claims, 17 Drawing Figures

ELECTROPLATING RACK

BACKGROUND OF THE INVENTION

FIGS. 1 to 8 inclusive of the drawings show known electroplating racks specifically designed to plate earrings for pierced ears. In each instance, there is an electrically conductive metal hanger frame 10 provided with a plurality of spaced, parallel hanger bars 12 and on each hanger bar a plurality of longitudinally-spaced hanger elements 14. The structure of the frame and bars, except for the portion of the frame above the top bar 12, is coated with plastisol.

The hanger elements 14 attached to the hanger bars of the structure shown in FIGS. 1 and 2 comprise electrically conductive metal sleeves 16 welded at one end to the hanger bars containing at their opposite ends internally thereof spring element 18—18 for frictionally receiving the stems of the earrings. In this form, the sleeve 16 as well as the frame and bars were coated with plastisol, leaving small holes at the end of the sleeves for receiving the stems of the earrings. The principal objections to the aforesaid structure are that leakage takes place about the stems where they enter the open colleted ends of the sleeves because the plastisol is not elastic enough to tightly grip the stems and because the openings through the plastisol become enlarged by repeated use.

Because of the aforesaid defects, hanger elements 14 such as shown in FIGS. 3 and 4 were made wherein electrically conductive metal studs 20 containing axial holes 22 closed at one end were welded to the hanger bars and the frame and hanger elements coated with plastisol except for the frame above the top bar and portions 23 of the studs. Sleeves 24 of rubber tubing containing axial passages 26 were inserted into the axial holes 22 in place of the spring fingers used in the hanger elements shown in FIG. 2 Caps 28 provided with axial holes 30 for receiving the uncoated portions 23 of the studs were applied thereto, the caps being provided with axial passages 32 coaxial with the passages 26 to receive the stems of the earrings. The caps were made by drilling the holes 30 and 32 in a rubber material made rigid by freezing. The drilling could not be accomplished accurately enough to provide a good seal and it was time-consuming and difficult to force the stems into the passages 32 because of their small size.

The structure shown in FIGS. 5 and 6 was then designed and tried wherein the hanger elements 14 comprised studs 34 provided at one end with threaded ends 36 for screwing into threaded holes 38 in the hanger bars. The studs contained axial passages 40 closed at one end and open at the other end and within the open ends there were fixed elastic spring metal elements 42. The studs were jacketed within a moldable resin material with the threaded ends extending from one end of the jackets and with their open ends recessed within the other ends of the jackets. Rubber tubes 44 were then inserted into the open ends of the jackets into engagement with the studs of sufficient length so that portions of the tubes extended beyond the jackets. The tubes contained passages of a size to elastically receive the stems of earrings. Unfortunately, the tubes 44 pulled out of the jackets each time the earrings were removed and, from repeated reinsertion, wore out in a very short time. Moreover, because the smallness of the passages 46, it was difficult and time-consuming to insert the stems of the earrings into the passages 46.

A somewhat simpler structure was then undertaken, FIGS. 7 and 8, wherein the stem of each earring was inserted through a hole 48 in a hanger bar without employing a hanger element per se and a part 50 comprised of rubberoid or other like material containing a hole 52 was forced over the stem, thus protecting the stem. This was inadequate because of leakage around the stem within the hole 48.

The rack which is the subject matter of this invention embodies certain of the features of the aforesaid racks improved upon in such a way as to overcome their deficiencies and, by such improved construction, to insure uniform plating and elimination of discoloration of the stems.

The invention will now be described in greater detail with reference to the accompanying drawings, wherein.

Figure 1:
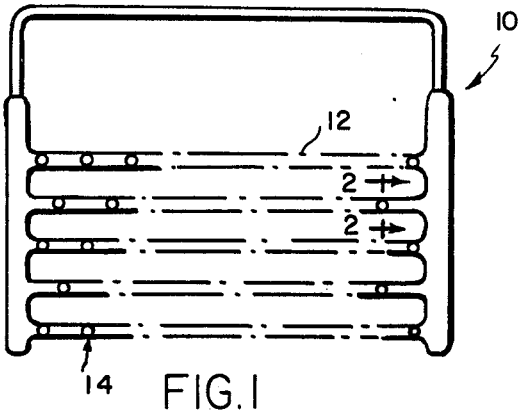
FIG.1 PRIOR ART
FIG. 1 is an elevation of a prior art electroplating rack.
Figure 2:
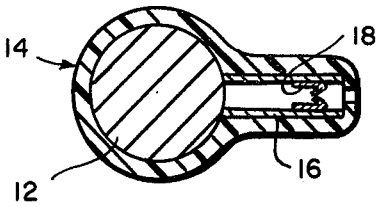
FIG.2 PRIOR ART
FIG. 2 is an enlarged section taken on the line 2—2 of FIG. 1.
Figure 3:
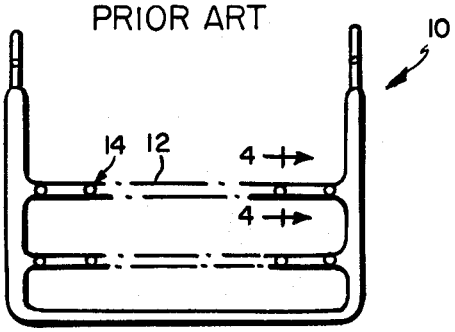
FIG.3 PRIOR ART
FIG. 3 is an elevation of another prior art rack.
Figure 4:
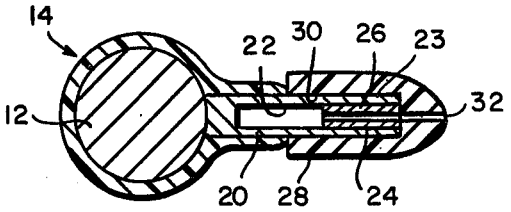
FIG.4 PRIOR ART
FIG. 4 is an enlarged section taken on the line 4—4 of FIG. 3.
Figure 5:
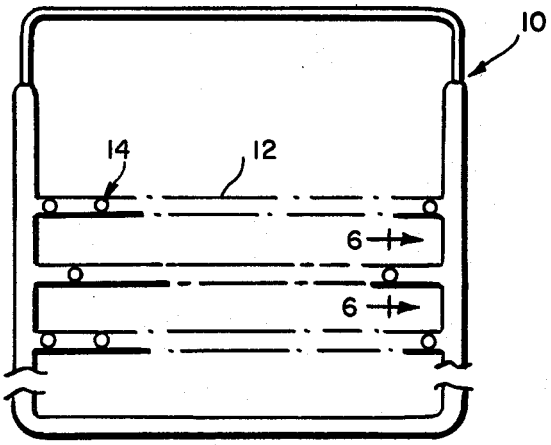
FIG.5 PRIOR ART
FIG. 5 is an elevation of still another prior art rack.
Figure 6:
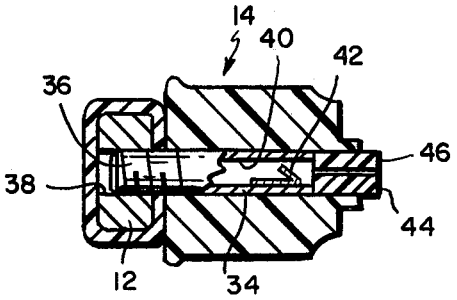
FIG.6 PRIOR ART
FIG. 6 is an enlarged section taken on the line 6—6 of FIG. 5.
Figure 7:
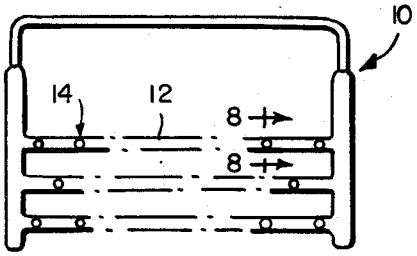
FIG.7 PRIOR ART
FIG. 7 is an elevation of still another prior art rack.
Figure 8:
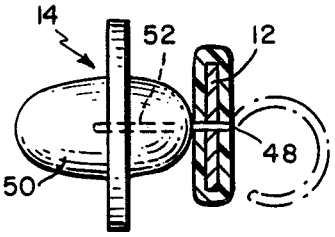
FIG.8 PRIOR ART
FIG. 8 is an enlarged elevation taken on the line 8—8 of FIG. 7.
Figure 9:
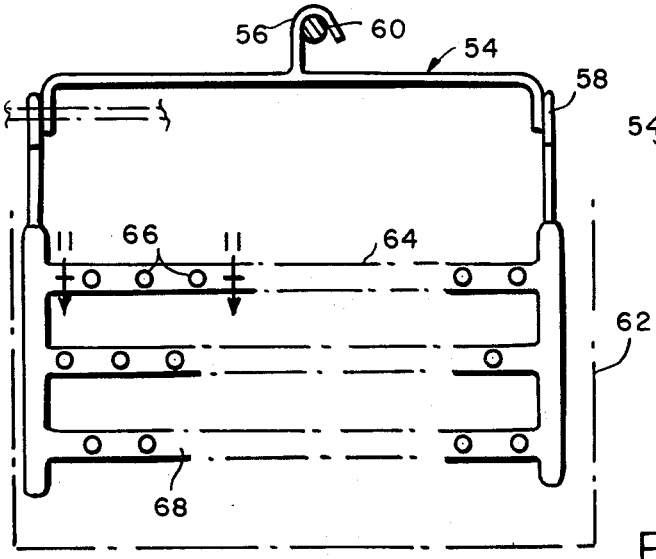
FIG. 9 is an elevation of the rack of this invention.
Figure 10:
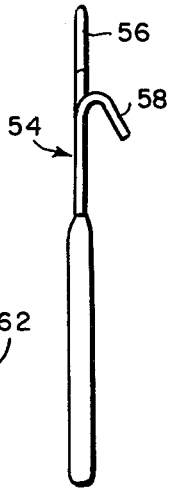
FIG. 10 is an end view of the rack shown in FIG. 9.
Figure 11:
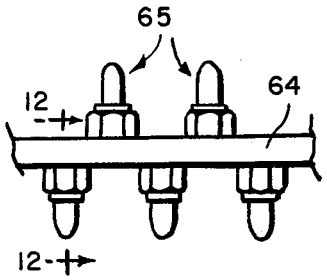
FIG. 11 is a fragmentary view taken on the line 11—11 of FIG. 9.

Referring to FIGS. 9 to 16, the grid for holding the articles to be electroplated according to the invention comprises a substantially U-shaped metal hanger frame 54 provided with hooks 56 and 58 by means of which it may be suspended from an electrically conducting bus bar 60 in a tank 62 shown in phantom. The transverse hanger bars 64 which are of generally rectangular cross section are welded at their ends to the legs of the frame and each of the hanger bars 64 contains a plurality of longitudinally-spaced, threaded holes 66 for removably receiving hanger elements 65. The legs of the hanger frame and the hanger bars are entirely covered, except for the upper part of the frame, with a heavy coating of plastisol 68.

The items which are to be electroplated and which are to be suspended in the electrolytic fluid by the grid are, in this particular case, pierced earrings, and the primary object of the invention is to provide hangers on the grid by means of which the earrings may be suspended in the electrolytic bath in such a way as to enable forming a blemish-free plating of the earrings without discoloration of the stems which, as pointed out heretofore, was one of the reasons why the aforesaid prior grids were unsatisfactory.

Figure 12:
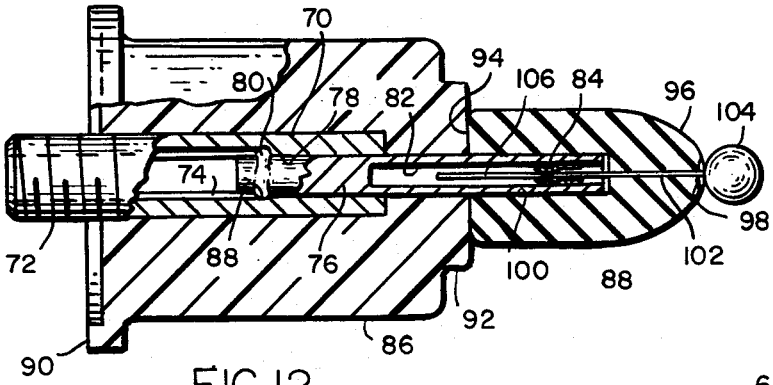
FIG. 12 is an enlarged section taken on the line 12—12 of FIG. 11.
Figure 13:
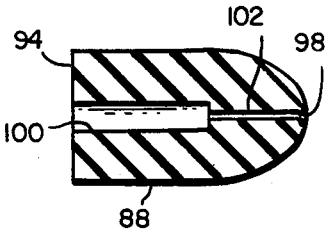
FIG. 13 is a longitudinal section of the cap removed from the hanger element.
Figure 14:
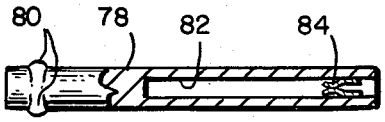
FIG. 14 is a view partly in elevation and partly in section of the collet member removed from the stud by means of which the hanger element is screwed to the hanger frame.
Figure 15:
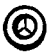
FIG. 15 is an end view of FIG. 14 showing the spring fingers constituting the collet-receiving portion of the hanger.
Figure 16:
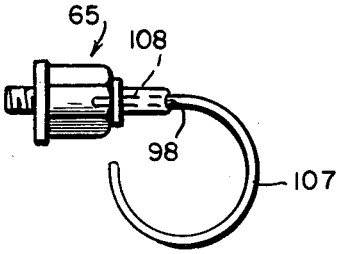
FIG. 16 is an elevation of a hanger element showing an earring inserted therein for plating.

The improved detachable hanger elements of this invention, one of which is screwed into each of the threaded holes 66, each comprise, as shown in FIGS. 12, 13 and 14, a metal stud 70 having at one end an external thread 72 and a smooth axial hole 84; a metal rod 76 having at one end diametrically disposed ears 80—80 and at its other end an axial passage 82 within which there are disposed spring fingers 84, three in number; a jacket 86 of chemically inert moldable plastic and a cap 88 of silicone rubber containing an axial hole and axial passage as will be described hereinafter.

The rod 78 is driven into the hole 74 in the stud 70, the ears 80—80 serving to anchor it firmly in place in concentric alignment with the axis of the stud with the colleted end extending axially beyond the end of the stud. The jacket 86 of chemically inert plastic which may, for example, be polypropylene, nylon, telfon, polyolefin and the like, is molded about the stud and rod so as to embed them within it with the threaded end of the stud extending from one end of the jacket and the colleted end of the rod extending from the other end of the jacket. Preferably, the jacket is molded to have a hexagonal cross section, thus to make it easy to use a socket wrench or the like for screwing the threaded end of the stud into the threaded openings in the hanger bars. The left end of the jacket as shown in FIG. 12 is molded to provide an annular rim 90 which may be seated firmly against the plastic coating of the hanger bars when the hangers are screwed into place. The right end of the jacket is molded to have a neck portion 92 of circular right section of much smaller cross sectional area than the body of the jacket.

The cap 88 is molded of silicone rubber or the equivalent, is of right circular section flat at one end 94 for abutting engagement with the end of the neck 92 and tapered or conical at the other end 96. At the tip of the taper, there is a concave recess 98. The end 94 contains an axial hole 100 of a diameter to sealably receive the colleted end of the rod 78 extending from the neck of the jacket and an axial passage 102 coaxial with the hole 100 extends from the inner end of the hole 100 to the tip through the concave recess 98. The passage 102 is of a diameter to sealably receive the stem of the earring so that its inner end extends into the collet. The length of the hole 100 is slighly longer than the length of the axially extending portion of the collet.

FIG. 12 shows an earring ball 104 provided with a stem 106, the latter being thrust through the passage 102 in the cap 88 and into the collet tube so that the ball is supported at the tip of the cap, but not in control therewith. A different type of earring in the form of a loop 107 provided with a stem 108 is shown thrust into a hanger element 65, FIG. 16.

One of the important advantages of the hanger constructed as described is that the collet extends appreciably beyond the jacket and the cap beyond the collet so that when the earring is mounted, no part will be so close to the hanger as to be shadowed by the hanger, a condition which results in non-uniform plating. The relatively small diameter of the cap and the tapered concave end avoid such shadowing.

Figure 17:
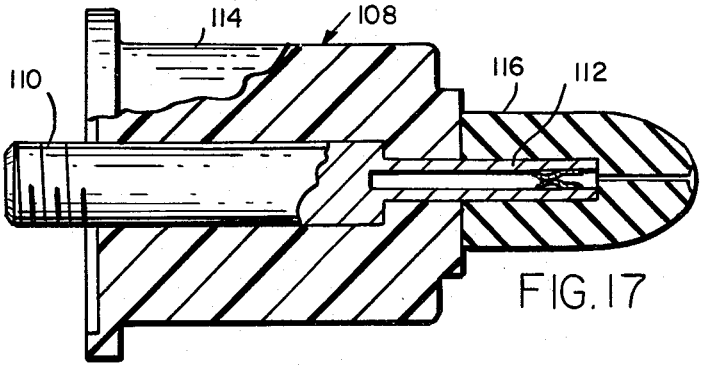
FIG. 17 is a section corresponding to FIG. 12. of alternative construction.

A simplified form of the hanger element 108 is shown in FIG. 17 wherein the stud and collet tube are combined with a thread 110 at one end and a collet tube 112 at the other. The combination part is provided with a jacket 114 and a cap 116 as described above.

The jacket material as related above is resistant to chlorinated solvents used in the electrolytic bath and to the high temperatures used to remove the plating solution from the plated items. The silicone rubber cap provides the elasticity necessary to withstand repeated insertion and removal of the stems of earrings and maintain a leaktight passage about the stem and the concave recess or dimple assists in inserting the stem into the passage. Moldable rubber-like materials which are the equivalent of silicone rubber in physical properties may be used in place of the silicone.

The component parts of the rack are readily replaceable and provide for uniform plating and the elimination of discoloration of the stems.

It should be understood that the present disclosure is for the purpose of illustration only and includes all modificiations or improvements which fall within the scope of the appended claims.

I claim:

1. A detachable hanger element for mounting to an electroplating rack comprising a conductive part threaded at one end and means at the other end portion defining a resiliently expandable collet for frictionally receiving and maintaining the stem of an earring to removably support the same for plating, a jacket of chemically inert plastic material within which said part is embedded with the threaded end extending from one end of the jacket and a portion of the colleted end extending from the other end of the jacket, and a removable cap mounted on the portion of the colleted end extending from the jacket with one end abutting the end of the jacket and the other end extending beyond the end of the colleted end, said cap containing an axial hole for receiving said colleted end of the conductive part and a passage extending axially from the end of the hole through the end of the cap of a diameter to receive the stem of the earring for engagement with the colleted end.

2. A hanger according to claim 1 wherein the other end of the cap tapers and contains a concave recess concentric with the passage.

3. A hanger according to claim 1 wherein said means defining the collet comprises spring fingers arranged symmetrically about the axis of the conductor.

4. A detachable hanger element for mounting to an electroplating rack comprising a metal stud externally threaded at one end, a collet member fixed in the other end of the stud, said collet member embodying jaws dimensioned to receive the stem of an earring, a jacket of chemically inert plastic material within which the assembly comprising the stud and collet member are embedded with the threaded end of the stud extending from one end of the jacket and a portion of the colleted member extending from the other end of the jacket, and a removable cap mounted on the portion of the collet member extending from the jacket with one end abutting the end of the jacket and the other end extending beyond the end of the collet member, said cap containing an axial hole for receiving said extending end of the collet member and a passage extending axially from the end of the hole through the end of the cap of a diameter to receive the stem of the earring for engagement within the collet.

5. A detachable hanger element for mounting to an electroplating rack comprising an elongate metal part threaded at one end and containing an axial passage at its other end, resiliently-expandable collet means at said other end for frictionally receiving the stem of an earring to removably support the earring on the electroplating rack during plating, said collet means being electrically conductive, a jacket of chemically inert plastic within which the elongate part is embedded with the threaded end extending from one end of the jacket and with that portion of the other end containing the collet means extending from the other end of the jacket and a removable cap mounted on the portion containing the collet means with one end abutting the jacket and the other end extending beyond the end of the portion containing the collet means, said cap containing an axial hole within which the portion containing the collet means is received and a coaxial passage extending from the end of the hole through the end of the cap of a dimension to receive the stem of the earring for frictional engagement with the collet means.

6. An electroplating rack comprising a conductive hanger frame, a plurality of spaced, parallel hanger bars fixed at their ends to the frame, a plurality of hanger elements mounted in spaced relation to each of the hanger bars and hook means for suspending the rack in a plating bath, said frame and hanger bars being coated with thermoplastic except for the portion of the frame above the hanger bars, each hanger element comprising a first part having at one end an attaching part by means of which it is conductively attached to a hanger bar and at its other end resiliently expandable collet means for frictionally receiving and supporting an earring on the rack for coating, a jacket of chemically inert plastic material within which the first part is embedded except for the attaching part at the one end and the collet means at the other and a slender cap applied to the colleted end of said first part, said cap containing an axial hole for snugly receiving the colleted end, and beyond the hole an axial passage which extends through the tip of the cap of a diameter to snugly receive the stem of the earring.

7. An electroplating rack according to claim 6 wherein the hanger bars contain longitudinally-spaced, threaded holes and the attaching parts of said parts are threaded for receipt within said threaded holes.

8. An electroplating rack according to claim 6 wherein the jacket has at one end a recess bounded by an annular shoulder for leak-tight engagement with the hanger bar.

9. An electroplating rack according to claim 8 wherein the jacket has at the other end an axial part of reduced right section terminating in a flat end face.

10. An electroplating rack according to claim 6 wherein the first part comprises an elongate tube containing an axial hole and a spindle, one end of which is wedged into the hole and the other end of which contains an elongate cylindrical hole within which are mounted spring fingers which constitute a collet at said end for frictionally receiving the stem of an earring.

11. A detachable hanger element for an electroplating rack comprising a part which is electrically conductive, means defining threads at one end of said part, means defining a collet at the other end of the part, a jacket of chemically inert, moldable resinous material within which the part is embedded with the threaded end projecting from one end of the jacket and the colleted end projecting from the other end of the jacket and a cap flat at one end and tapered at the other applied to the collet with the flat end abutting the jacket, said cap containing an axial hole for sealably receiving the colleted end and an axial passage extending therefrom through the tapered end of the cap for releasably receiving the stem of an earring, the means defining a concave recess concentric with the passage at the tapered end for guiding the stem into the passage.

* * * * *